US005497636A

United States Patent [19]

Felcher

[11] Patent Number: 5,497,636

[45] Date of Patent: Mar. 12, 1996

[54] NECKLACE SHORTENING AND FASTENING APPARATUS AND METHOD

[76] Inventor: Rita Felcher, 3725 Henry Hudson Pky., Riverdale, N.Y. 10463

[21] Appl. No.: 241,381

[22] Filed: May 11, 1994

[51] Int. Cl.[6] ..... A44C 25/00

[52] U.S. Cl. ..... 63/2; 24/573.3; 24/370

[58] Field of Search ..... 63/2, 3; 24/573.2, 24/370, 698.3, 601.3, 601.8, 601.9, 116 R

[56] References Cited

U.S. PATENT DOCUMENTS

| | | | |
|---|---|---|---|
| 401,746 | 4/1889 | Johnstone . | |
| 703,842 | 7/1902 | Smith | 24/573.3 |
| 1,497,710 | 6/1924 | Cole . | |
| 1,578,940 | 3/1926 | Wacha . | |
| 1,667,541 | 4/1928 | Edeburn | 24/573.3 |
| 1,720,472 | 7/1929 | Gagnon . | |
| 1,724,835 | 8/1929 | Goodridge . | |
| 1,740,992 | 12/1929 | McCretton . | |
| 2,320,067 | 5/1943 | Caughren | 24/370 |
| 2,521,589 | 9/1950 | Livingston | 63/2 |
| 2,607,977 | 8/1952 | Serrell | 24/370 |
| 2,930,209 | 3/1960 | Altman . | |
| 3,071,938 | 1/1963 | Davidson . | |
| 3,168,768 | 2/1965 | Bohlinger et al. . | |
| 3,170,311 | 2/1965 | Raphael . | |
| 3,181,217 | 5/1965 | Bohlinger et al. . | |
| 3,224,060 | 12/1965 | Ogden . | |
| 3,225,565 | 12/1965 | Bohlinger et al. . | |
| 3,271,977 | 9/1966 | Bohlinger et al. . | |
| 3,386,240 | 6/1968 | Blunstein | 63/2 |
| 3,828,577 | 8/1974 | Haynes . | |
| 3,983,716 | 10/1976 | Kuhn . | |
| 4,406,296 | 9/1983 | Wexler et al. . | |
| 4,530,221 | 7/1985 | Weinberg . | |
| 4,573,243 | 3/1986 | Plaza . | |
| 5,007,252 | 4/1991 | Mochizuki . | |
| 5,125,244 | 6/1992 | Zwart | 63/2 |

FOREIGN PATENT DOCUMENTS

| | | | |
|---|---|---|---|
| 1096102 | 6/1955 | France | 24/370 |
| 2274236 | 7/1994 | United Kingdom | 63/2 |

*Primary Examiner*—Flemming Saether
*Attorney, Agent, or Firm*—Kenyon & Kenyon

[57] ABSTRACT

An apparatus and method for fastening and shortening loop type necklaces or chains using a fastener device having no moving parts which includes a fastener body formed to include first and second fastener curves and first and second fastener holding spaces. The fastener device operates to engage respective ends of a necklace and hold such ends in corresponding fastener holding spaces such that the fastener device balances the pull of each of the ends of the necklace.

14 Claims, 7 Drawing Sheets

NECKLACE SHORTENING AND FASTENING APPARATUS AND METHOD

FIELD OF THE INVENTION

The present invention relates to jewelry devices and methods for using same. In particular, the present invention relates to an apparatus and method for shortening and fastening normally long bead, pearl or chain necklaces such that they can be worn at different and shorter lengths around a user's neck.

BACKGROUND OF THE INVENTION

Long, bead or pearl loop-type necklaces have been, and continue to be, one of the most popular jewelry items in the world of fashion and in the jewelry collections of most women. These necklaces, however, are not always the appropriate jewelry accessory for all occasions, clothing ensembles or necklines. Acquiring multiple necklaces including long and short, twisted and straight varieties is often economically impractical. It is, therefore, desirable to have some way of modifying long necklace lengths, and/or their appearance. It is also desirable to facilitate combining such necklaces and without permanently altering one or more of them. With this capability, women could easily transform one or combinations of these necklaces into chokers or draped collars, with twisted or straight appearances, as the need arises, thereby increasing the necklaces' versatility and usability. It would also provide women with various length options and color and bead combinations that could only be achieved by their buying a considerable number of separate necklaces to suit a range of occasions and practically every article of clothing in their wardrobes.

Known devices for shortening and/or fastening necklaces have concentrated on mechanical fastening mechanisms or clasps comprised of movable arms, joints and hinges. These devices tend to either break or fatigue from use or otherwise fray or tear bead stringing or knotting elements of the necklace. In addition, devices of this sort have, for the most part, been necklace-specific, requiring beads of particular sizes for proper operation. Where such fasteners are tried with other necklace bead sizes, the fasteners invariably are too small to accommodate one or more necklaces. Such mechanisms also tend to be unwieldy and difficult to manipulate including placement of the beads and opening and closing of the fastener. These difficulties are further exacerbated if the user has long fingernails.

It would, therefore, be desirable to have a necklace fastener and shortener which could accommodate a variety of bead sizes and necklace combinations while being constructed for simple, straight-forward fastening and shortening. It would also be desirable to have a fastener and shortener which is inexpensive and which does not harm the necklace beads or interconnecting material.

SUMMARY OF THE INVENTION

The present invention relates to a device for shortening and fastening loop necklaces. The fastener device comprises a fastener body having a rigid construction and having no moving parts. The fastener body includes first and second fastener ends and further includes first and second fastener curves formed from the fastener body. The fastener curves include corresponding arms and each forms a fastener holding space to accept a respective necklace end. The first fastener curve is formed to ensure that the first fastener end is a first predetermined distance from the fastener body resulting from the first arm being at an angle relative to the fastener body. The second fastener curve is formed to provide for the second arm to remain substantially parallel to the fastener body and to be relatively longer than the first arm.

The fastener device of the present invention is designed for shortening and fastening loop necklaces by engaging a respective fastener end to a necklace end while holding the other necklace end and twisting the device until the desired length is achieved. At that time, the unengaged fastener end is simply placed over and through the hand held necklace end thereby securing it in the fastener holding space. While engaged with the respective ends of a necklace, the fastener device balances the forces that the necklace ends exert on the first and second curves. The fastener device of the present invention can be formed from a variety of materials and can even be constructed into a variety of shapes.

DETAILED DESCRIPTION OF THE PREFERRED EMBODIMENT

Figure 1:
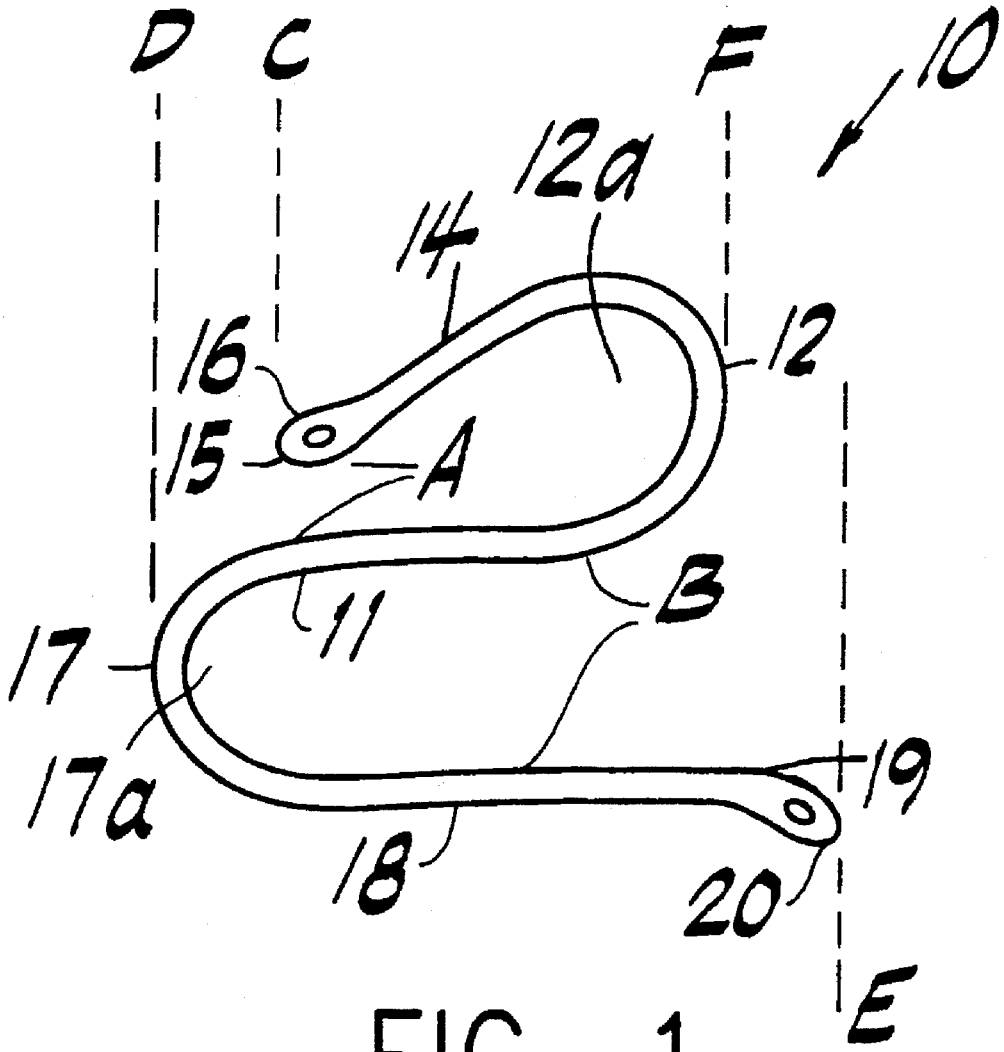
FIG. 1 is an illustration of the shortener and fastener apparatus of the present invention.

Referring to FIG. 1, there is illustrated the shortener and fastener apparatus 10 of the present invention. The apparatus 10 comprises a fastener body 11 formed, preferably, from an unseamed, single length of relatively thin, smooth, evenly gauged, highly polished, round 14 karat gold hard wire. For best results and to ensure the requisite strength of the fastener body 11, such wire should be approximately 0.060 inches in diameter. This preferred construction provides for a relatively rigid fastener body 11 to resist bending of the fastener apparatus 10 when engaged.

In addition to the use of 14 karat gold for the construction of the fastener body 11, other materials may be used. For example, any evenly gauged, round, smooth precious metal alloy, base metal or base metal alloy wire may be used with successful results provided such wire has the approximate tensile strength and/or diameter of the gold wire described above. Specifically, diameters may be modified in proportion to the strength of the material used. In particular, such metals containing rhodium, 14 karat or 18 karat gold (yellow or white), sterling silver, or constructed to be gold filled or gold plated would be acceptable in the appropriate diameter or wire gauge. Other metals include, but are not limited to, brass, copper, nickel, tin, steel, stainless steel, pewter, aluminum, palladium and titanium, whether polished, matte, coated, color-anodized, anodized, plated, lacquered or annealed.

The fastener body 11 may also be constructed from molded metals which approximate the size and strength of the preferred arrangement described above. Also, plastics and acrylic plastics may be used to form the fastener body 11, or certain minerals including rose quartz, onyx, serpentine, malachite, carnelian, aventurine or other materials. Finally, certain woods may be used such as birch, chestnut or teak usually when stained and lacquered.

Referring again to FIG. 1, the fastener body 11 forms a first fastener curve 12 having a first arm 14 which extends to a first fastener end 15, which first fastener end 15 may include a first loop 16. The first fastener curve 12 of the fastener body 11 is ordinarily in the same plane as the body 11. The first arm 14 of the first fastener curve 12 is disposed at an angle to the fastener body 11 in order to cause the first fastener end 15 of the fastener apparatus 10 to be positioned within a first predetermined distance A of the fastener body 11. The fastener apparatus 10 forms a first fastener holding space 12*a* bounded on three sides by the fastener body 11, the first fastener curve 12 and the first arm 14. The first fastener holding space 12*a* takes the shape of its boundaries (11, 12, 14). Although it is preferred that the form of the fastener body 11 around the first fastener holding space be curved, the fastener apparatus 10 of the present invention may be implemented using other geometric shapes such as a diamond shape, or a triangular shape.

The first predetermined distance A can vary between different fasteners 10, however for each fastener 10, once determined, remains substantially constant over the life of the fastener 10. The preferred first predetermined distance A has been found to fall within the range of 1/8 to 7/32 of an inch.

The fastener body 11 also forms a second fastener curve 17 having a second arm 18 which extends to a second fastener end 19, which second fastener end 19 may include a second fastener loop 20. The second fastener curve 17 of the fastener body 11 is ordinarily in the same plane as the body 11, however, the second fastener curve 17 may also be constructed to provide for the second arm 18 to be disposed at an angle to the plane of the body 11. The second arm 18 is otherwise kept substantially parallel in the same plane to the fastener body 11 such that a second predetermined distance B exists between the second arm 18 and the body 11. The second predetermined distance can vary between different fasteners 10, however, for each fastener 10, once determined, remains substantially constant over the life of the fastener. The preferred second predetermined distance B has been found to fall within the range of 1/2 inch to 19/32 of an inch.

Similar to the first fastener curve 12 discussed above, the fastener apparatus 10, forms a second fastener holding space 17*a* bounded on three sides by the fastener body 11, the second fastener curve 17 and the second arm 18. The second fastener holding space 17*a* takes the shape of its boundaries (11, 17, 18). Although it is preferred that the form of the fastener body 11 around the second fastener holding space be curved, the fastener apparatus 10 of the present invention may be implemented using other geometric shapes such as a rectangular shape.

The fastener 10 of the present invention can be produced in a variety of shapes and sizes to accommodate the variety of uses for which it is designed. It has been determined that the preferable design provides for the first fastener end 15 to extend, relative to the second fastener curve, to a point (See FIG. 1, reference line C) at or near the outermost extension of the second fastener curve 17 (See FIG. 1, reference line D), but not beyond. Also, the preferable design provides for the second fastener end 19 to extend to a point (See FIG. 1, reference line E) beyond the position of the first curve 12 (See FIG. 1, reference line F). The result is a swan shaped fastener body 11 wherein the second arm 18 is relatively longer than the first arm 14.

Figure 1A:
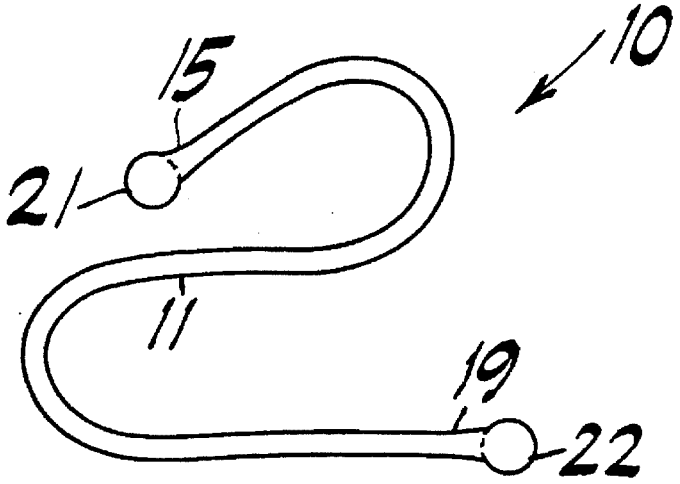
FIG. 1A is an illustration of the shortener and fastener apparatus of the present invention having decorative ends.

The fastener apparatus 10 may be modified to include decorative ends in place of either or both the first or second loops (16 and 20, respectively). The first and second fastener loops (16 and 20) may be formed from the wire (bent into position) or mold itself, or they may be attached to the fastener ends, 15 and 19, by soldering or other methods. Decorative fastener ends add to the aesthetic appearance of the fastener 10 and to the necklace arrangement as a whole. For example, referring to FIG. 1A, there is an illustration of the fastener body 11 having its first fastener end 15 adorned by a sphere 21. The sphere 21 may comprise, in the case of the gold wire fastener 10, a gold ball and may be soldered or otherwise affixed to the fastener end 15. Other materials may also be used for these spheres 21 consistent with the discussion above relating to the fastener body 11 materials. The same arrangement may also be used at the second fastener end 19 of the fastener body 11 using another sphere 22. It has been determined that such spheres are best applied in a size approximately 4 mm in diameter. However other sizes may be used.

Figure 1B:
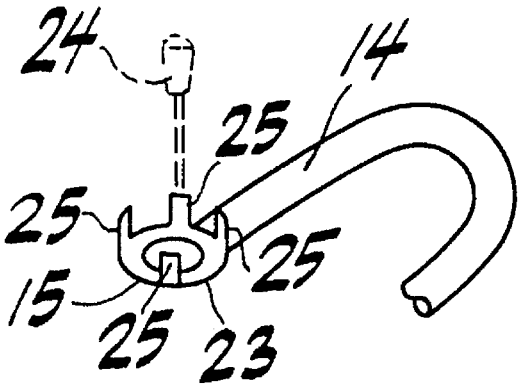
FIG. 1B is an exemplary illustration of one embodiment of the shortener and fastener apparatus of the present invention having decorative ends.

In addition to decorative spheres 21, 22 each fastener end 15, 19 of the fastener body 11 may be adorned with illusion, pronged or bezel settings designed to accept precious or semi-precious stones, pearls, or faux stones. For example, referring to FIG. 1B, there is illustrated a decorative end of the fastener body 11 including a pronged setting. In this exemplary illustration only the first arm 14 of the fastener body 11 is shown. The first fastener end 15 of the first arm 14 may be flattened and drilled to form a setting platform 23 in which a stone 24 is placed and fastened in place by prongs 25 appropriately affixed to the setting platform 23. Other methods of affixing the stone to the setting platform 23 are also acceptable. It has been determined that stones are best sized in the range of 2 mm to 4 mm when deployed in the arrangement depicted by FIG. 1B. However, other sizes and deployments are possible. The precious and semi-precious stones which may be used include, but are not limited to: diamonds, emeralds, sapphires, rubies, aquamarines, onyx, garnet, malachite, lapis lazuli, carnelian, aventurine, and peridot. Of course, a myriad of stones in the faux genre may also be used.

Figure 2:
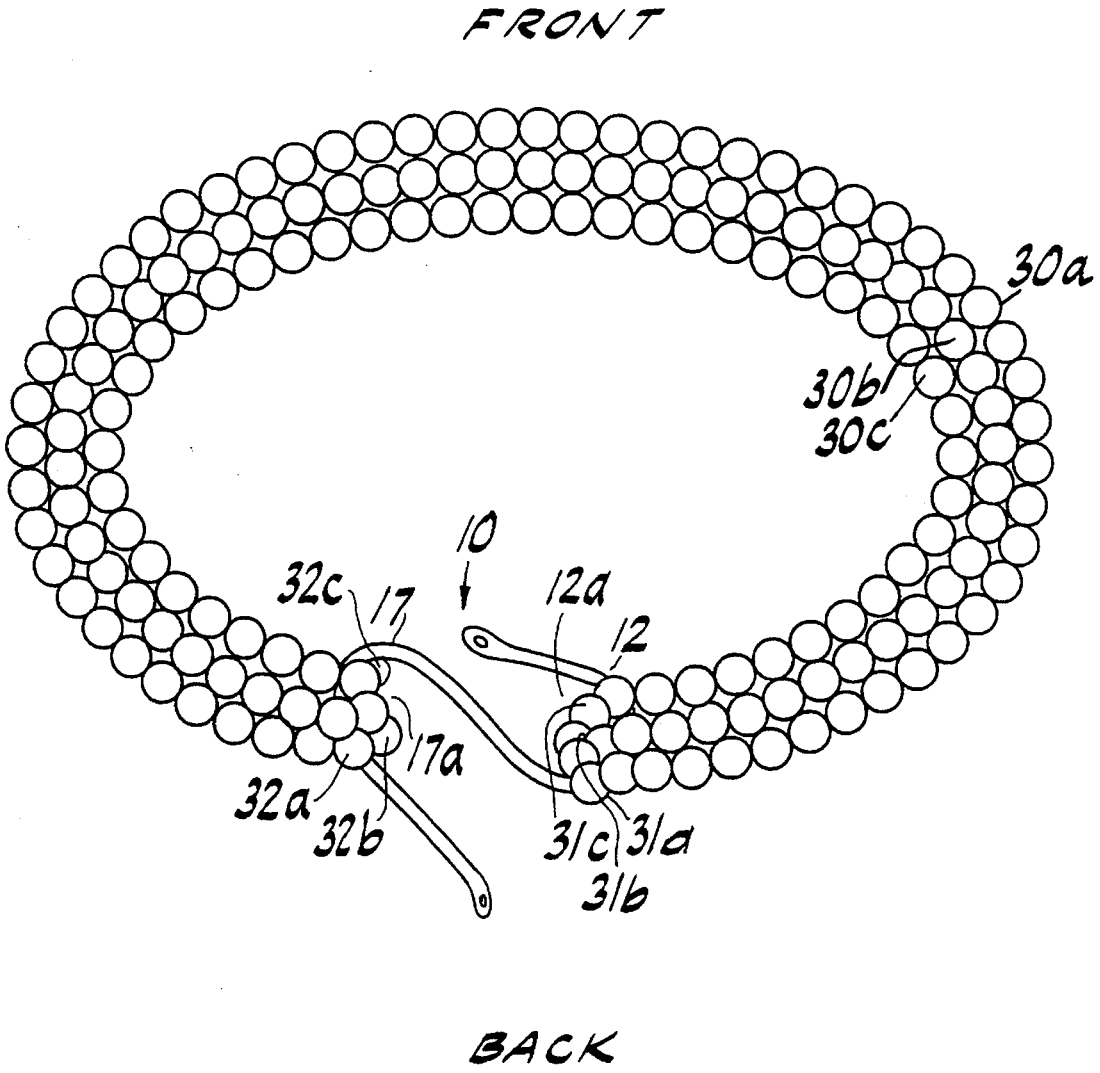
FIG. 2 is an illustration of the shortener and fastener apparatus of the present invention being used to shorten and fasten the ends of at least three bead necklaces.

Referring to FIG. 2, the fastener 10 of the present invention is illustrated in an engaged position with at least three bead necklaces 30(*a*), 30(*b*) and 30(*c*). As shown in FIG. 2, each of the necklaces 30(*a*), 30(*b*) and 30(*c*) have first and second necklaces ends (See 31(*a*), 31(*b*), 31(*c*) and 32(*a*), 32(*b*), (*c*), respectively) which ends are formed, for example, when a beaded loop necklace is engaged by the fastener as shown. In this engagement, three first necklace ends 31(*a*), 31(*b*) and 31(*c*) are positioned in the first fastener holding space 12*a* of the fastener 10 while three second necklace ends 32(*a*), 32(*b*) and 32(*c*) are positioned in the second fastener holding space 17*a* of the fastener 10.

As shown in FIG. 2, when the engaged fastener 10 and necklaces 30(*a*), 30(*b*) and 30(*c*) are around a user's neck, the fastener typically is positioned behind the neck (in the back). In the engaged position, the fastener 10 assumes a position as illustrated in FIG. 2 due to the pull of the respective necklace ends 31(*a*), 31(*b*), 31(*c*) and 32(*a*), 32(*b*), 32(*c*) when around a user's neck exerting equal but opposite forces against the respective fastener curves 12 and 17. The first fastener curve 12 of the fastener apparatus 10, while holding the first necklace ends 31(*a*), 31(*b*), 31(*c*), tilts downward, while the second fastener curve 17, holding the second necklace end 32(*a*), 32(*b*), 32(*c*), tilts upward thereby maintaining a balance of the respective fastener curves, 12 and 17 of the fastener apparatus 10. This upward downward tilt and balance of the respective fastener curves occurs whether one necklace or multiple necklaces are used.

A clearer understanding of the operation of the fastener 10 of the present invention is made possible by a more detailed description of the necklaces which are fastened and shortened by it. Necklaces of the type used with the fastener 10 of the present invention, typically comprise a plurality of beads and/or pearls of the same size and shape or different size beads in a variety of combinations and shapes ranging from approximately 5 mm up to approximately 16 mm arranged in a continuous loop. These beads, pearls or geometrics are typically strung, knotted, or otherwise movable along a flexible string, or interconnected with metal loops. The bead strand ends may be fastened to each other by a concealed interlocking system or knot. These typical fastened strands of beads form loop necklaces in the range of 32 inches to 38 inches in the round. It is such necklaces which are shortened and fastened by the apparatus of the present invention.

Figure 3:
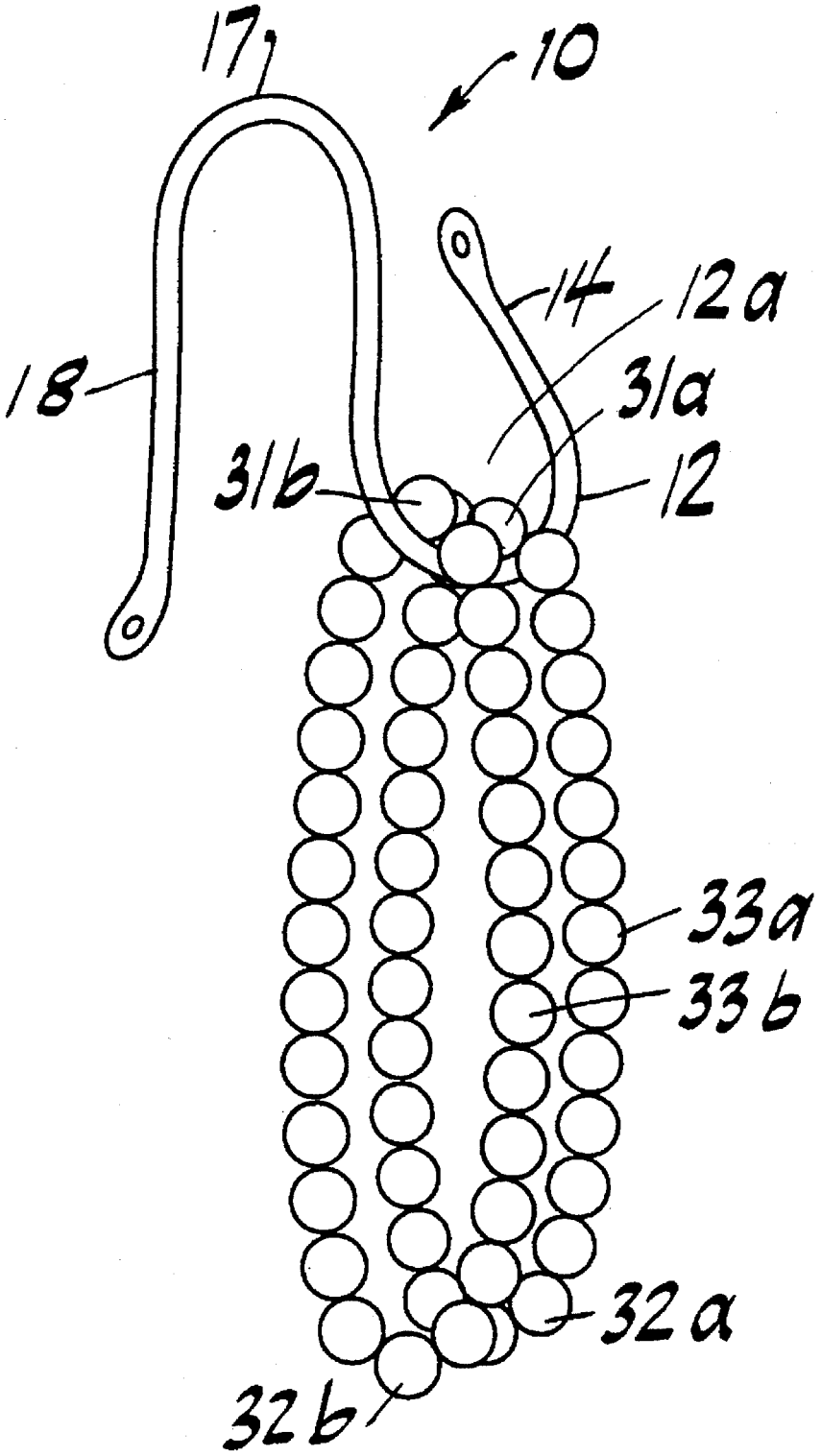
FIG. 3 is an illustration of the shortener and fastener apparatus of the present invention attached to one end of each of two bead necklaces.

Referring now to FIG. 3, the fastener 10 is illustrated in a partially engaged position whereby first necklace ends 31(*a*) and 32 (*b*) of two loop necklaces 33(*a*) and 33(*b*) are positioned inside of the first fastener holding space 12*a* of the fastener 10.

Figure 4A:
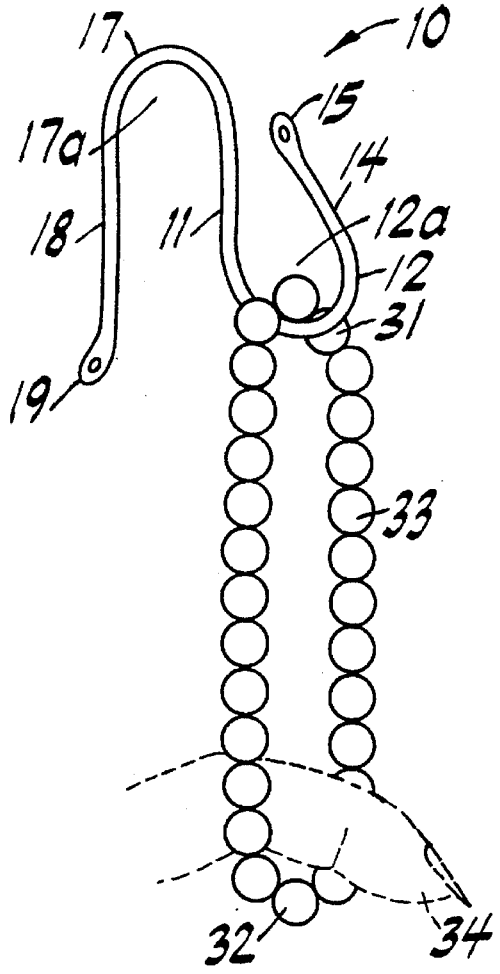
FIGS. 4A–4D are illustrations of the steps used to engage the shortener and fastener apparatus of the present invention with at least one bead necklace.
Figure 4B:
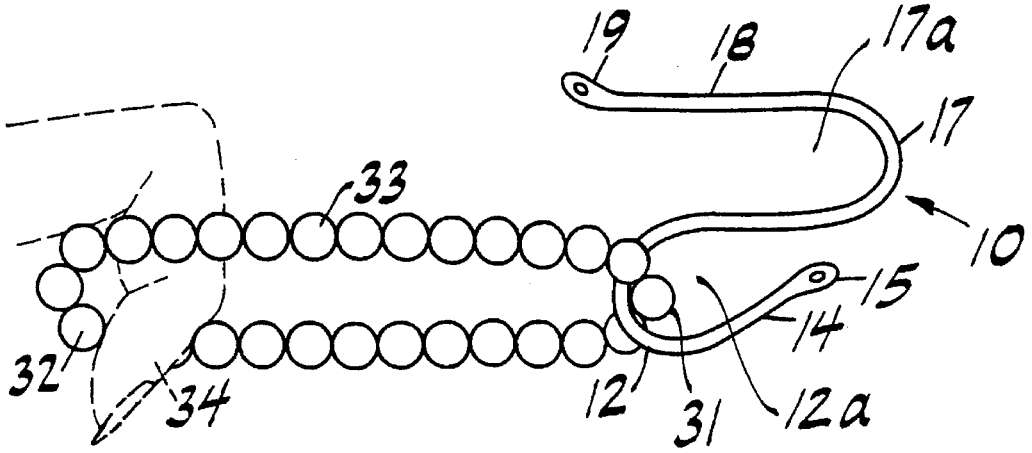

Referring now to FIGS. 4A through 4D, the procedure employed for engaging one or more necklaces 33 with the fastener 10, is illustrated. In FIGS. 4A and 4B, the fastener 10 is shown with only one necklace 33 engaged in the first fastener holding space 12*a* held by the first fastener curve 12 of the fastener 10. The necklace 33 is engaged by the first fastener curve 12 by looping the first necklace end 31 around the first fastener end 15 of the fastener body 11 into the first fastener holding space 12*a*. The user's finger 34 may then engage the second necklace end 32 and pull it in a horizontal position where the necklace 33 may then be placed around the user's neck and wherein the second fastener end 19 of the fastener body 11 may be extended through the necklace loop formed at the second necklace end 32, causing the second necklace end 32 to be secured in the second fastener holding space 17*a*.

Figure 4C:
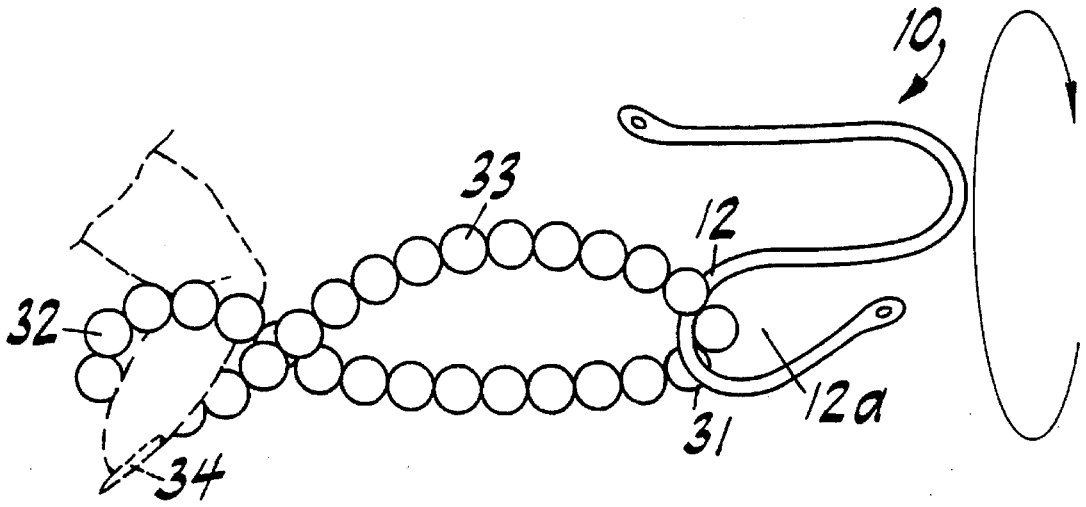
Figure 4D:
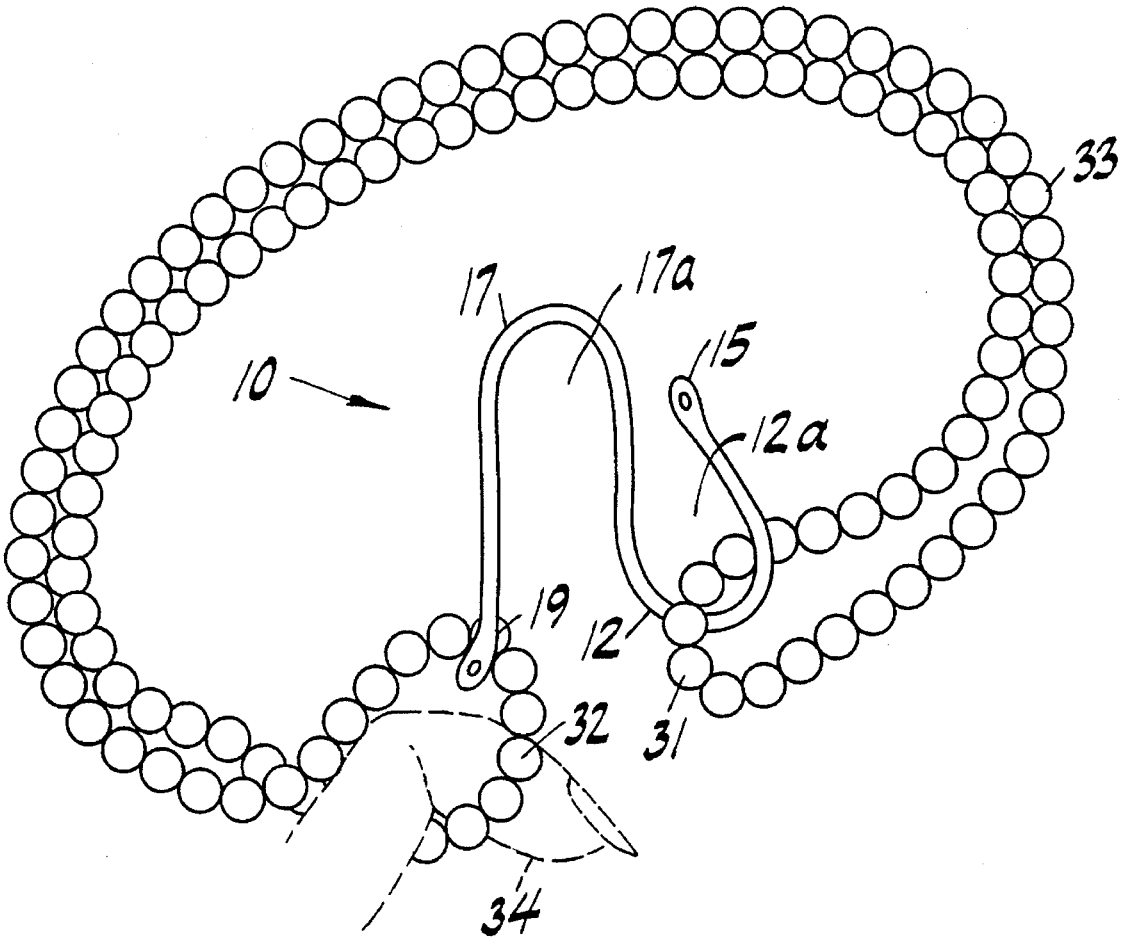

Referring now to FIGS. 4C and 4D, the necklace 33 may be twisted in the fashion shown by keeping a finger 34 through the second necklace end 32 and rotating the fastener 10 which is engaged with the first necklace end 31 in the first fastener holding space 12*a*. The rotation can be either clockwise or counterclockwise. The result of such twisting is a shortened necklace 33 which necklace's second end 32 may then be engaged by the fastener 10, by inserting the second fastener end 19 into the loop at the second necklace end 32 (See FIG. 4D), so that the second necklace end 32 is encircled by the second fastener holding space 17*a* and held by the second fastener curve 17 of the fastener 10 thereby securing the necklace 33.

The use of the fastener 10 to engage necklace 33 can involve more than one necklace and more than one necklace length. Indeed, several necklaces can be twisted together and secured in the fashion described above. Adjustments of length are easily achieved by temporarily disengaging the second fastener end 19 of the device from the second necklace end 32 and simply rotating the necklace end 32 and/or device to shorten or lengthen the necklace. With this fastener, a draping affect is as easy to achieve as a choker effect using the same procedure.

The manual dexterity required to operate this invention is minimal. Since the fastener 10 and its separate fastener holding spaces 12*a*, 17*a* and fastener ends 15, 19 which engage the necklace are part of the same structure, necklace ends 31, 32 remain relatively stationary during hand/device manipulation which is, therefore, unencumbered and easily accomplished.

Since the components of this rigid, one-piece structure are large enough to hold comfortably and easily, and since there is no bending or moving parts, and no mechanical mechanisms too difficult to open and close, and no uncontrollable components to hold or manipulate, nothing interferes with the simple, easy shortening and fastening process of this invention.

There are other ways to manipulate the structure during the shortening/fastening process which are as simple as the above. As the wearer uses the device, these variations will become apparent.

Although the present invention is illustrated and described with respect to connected bead components, it should be noted that the device easily and effectively shortens long chain necklaces as well—either singly or in combination with necklaces with bead components.

What is claimed is:

1. A device for fastening at least one loop necklace comprising:

a fastener body of rigid construction and having no moving parts, said fastener body comprising first and second fastener ends, said fastener body formed to include a first fastener curve formed from said fastener body, having a first arm extending to the first fastener end, said first arm arranged to angle toward the fastener body providing for said first fastener end to be a predetermined first distance from said fastener body;

a first fastener holding space bounded by at least said first fastener curve and first arm and having a first opening comprising the first predetermined distance;

a second fastener curve formed from said fastener body, having a second arm extending to the second fastener end, said second arm arranged to extend to a point beyond the position of first curve and remain substantially parallel to said fastener body thereby maintaining a second predetermined distance from said fastener body; and a second fastener holding space bounded by at least said second fastener curve and second arm and having a second opening comprising the second predetermined distance.

2. The device of claim 1 wherein said fastener body is constructed of metal.

3. The device of claim 2 wherein said metal comprises round, hard gold wire.

4. The device of claim 2 wherein said gold wire is approximately 0.060 inches in diameter.

5. The device of claim 1 wherein said fastener body is constructed of plastic.

6. The device of claim 1 wherein said fastener body is constructed of wood.

7. The device of claim 1 wherein said fastener body, said first fastener curve and said second fastener curve form a swan shape.

8. The device of claim 1 wherein each of said first and second fastener ends comprises an end loop.

9. The device of claim 1 wherein at least one of said first and second fastener ends further comprises a decorative end fixedly mounted thereon.

10. The device of claim 9 wherein said decorative end comprises a sphere.

11. The device of claim 9 wherein said decorative ends comprise a jewelry setting for fixedly mounting a stone.

12. The device of claim 1 wherein the first predetermined distance is in the range of 1/8 to 7/32 of an inch.

13. The device of claim 1 wherein the second predetermined distance is in the range of 4/8 to 19/32 of an inch.

14. The device of claim 1 wherein the second arm is relatively longer than the first arm.

* * * * *